US007930906B2

(12) United States Patent
Dietz et al.

(10) Patent No.: US 7,930,906 B2
(45) Date of Patent: Apr. 26, 2011

(54) SLIDER NEEDLE WITH BUILT-IN CENTER STRIP

(75) Inventors: Andreas Dietz, Geislingen (DE); Wolfgang Schmoll, Haigerloch-Owingen (DE); Klaus Ruoff, Albstadt (DE); Jürgen Schneider, Balingen-Frommern (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/881,838

(22) Filed: Sep. 14, 2010

(65) Prior Publication Data

US 2011/0072859 A1 Mar. 31, 2011

(30) Foreign Application Priority Data

Sep. 30, 2009 (EP) ..... 09012384

(51) Int. Cl.
*D04B 35/06* (2006.01)

(52) U.S. Cl. ..... 66/120; 66/123

(58) Field of Classification Search ..... 66/116, 66/119, 120, 121, 122, 123
See application file for complete search history.

(56) References Cited

U.S. PATENT DOCUMENTS 4,043,153 A * 8/1977 Lindner et al. ..... 66/120
5,937,673 A * 8/1999 Shima ..... 66/120
6,233,977 B1 * 5/2001 Schuler et al. ..... 66/120
6,339,942 B1 * 1/2002 Majer et al. ..... 66/120
6,422,045 B1 * 7/2002 Morita et al. ..... 66/120
6,510,713 B1 * 1/2003 Shima ..... 66/120
6,568,223 B1 * 5/2003 Morita ..... 66/120
6,915,667 B2 * 7/2005 Morita et al. ..... 66/120
7,152,437 B2 * 12/2006 Morita ..... 66/120

FOREIGN PATENT DOCUMENTS

EP 1424417 6/2004
EP 1574610 9/2005
EP 1229159 3/2006

OTHER PUBLICATIONS

G. Niemann et al.; "Maschinenelemente"; Dec. 31, 2001; Springer Verlag, XP-002572601, (ISBN 3540658156) pp. 376-382.

* cited by examiner

*Primary Examiner* — Danny Worrell
(74) *Attorney, Agent, or Firm* — Fitch, Even, Tabin & Flannery; Norman N. Kunitz

(57) ABSTRACT

A slider needle (1) having a partition element (15) clipped through an insertion slit (19) in the needle base body (2). The partition element (15) is shaped such that it can be easily inserted in the needle base body 2, but is still securely held, optionally with some play, as a result of positive engagement. The partition element comprises, preferably as a one-piece component, a spring part (25) and a foot extension (26) interacting with the bottom (17) of the slider slit. Preferably, the foot extension 26 has two sections (27, 28, 27*a*, 28*a*) that are bent in opposite directions, either in a transverse or a longitudinal direction of the otherwise flat partition element (15). In the region of the insertion slit (19), the back (18) of the needle base body (2) has an indentation (24) so that the bent over sections (27, 28, 27*a*, 28*a*) cannot project beyond the needle back (18).

15 Claims, 4 Drawing Sheets

SLIDER NEEDLE WITH BUILT-IN CENTER STRIP

CROSS-REFERENCE TO RELATED APPLICATION

The present application claims the priority of European Patent Application No. 09 012 384.5, filed Sep. 30, 2009, the subject matter of which, in its entirety, is incorporated herein by reference.

BACKGROUND OF THE INVENTION

The invention relates to a slider needle for knitting machines.

Slider needles comprising a divided slider have been known. Such sliders have at least two legs that run in a slider channel and are held at a distance from each other by means of a center strip.

Such a slider needle comprising a center strip has been known from EP 1 229 159. In this document, the center strip is a one-piece component of the needle body. The implementation of this idea necessitates high manufacturing costs and results in a rigid support of the center strip.

Likewise, a slider needle with a center strip has been known from document EP 1 424 417. This center strip is configured so as to represent a separate partition element that is later inserted in the needle base body and fastened thereto in a non-detachable manner. The slider channel of this slider needle is delimited by two lateral walls and one bottom. A larger opening extending through the bottom as well as also partially through one lateral wall accommodates the extension of the partition element. The extension is laterally accessible through the opening. This extension is set into the needle so that a durable immovable connection is established. However, the manufacturing efforts are considerable. Due to the application of said opening in a manner asymmetrical relative to the center plane, the resultant needle is subject to considerable weakening. For example, if the needle is subject to any bending stress due to the pull of the knit material suspended from said needle, the center strip may detach. Furthermore, considering this idea, it is relatively difficult to achieve sufficient precision, in particular, from the viewpoint of any positioning of the partition element.

If any element detaches from the needle such as, for example, the partition element, and enters into the knitting machine, the uncontrollably moving partition element may end up causing significant damage to the knitting machine.

Considering this, it is the object of the invention to state an improved idea for slider needles comprising a center strip element.

SUMMARY OF THE INVENTION

The above object generally is achieved according to the present invention with a slider needle that comprises a needle body, the bottom of the slider channel of said needle body being provided with at least one opening. A foot extension of a partition element located in the slider channel extends through said opening. The foot extension extends downward under the bottom of the slider channel, securing the partition element in a positive-locking manner in the slider channel. By having the foot extension extend downward under the bottom, it is ensured that the partition element will not detach from the slider needle and move in the knitting machine in an uncontrolled manner.

Preferably, the opening in the bottom of the slider channel has the shape of a slit. Preferably, said opening extends in longitudinal direction of the slider channel. Considering a preferred embodiment, the opening maintains a distance from both lateral walls. In other words: on both sides of the preferably slit-like opening, there are strip-shaped bottom regions that are respectively delimited by one lateral wall, on the one hand, and by the opening, on the other hand. Preferably, these two strip-shaped bottom regions are located on the same plane. Preferably, the bottom regions form sliding surfaces for the two legs of the slider. Stated differently: the slit that represents, e.g., an elongated oval, is circumscribed by the bottom along the entire circumference of the slit.

The partition element has an essentially rectangular form and is configured as a thin plane flat part. Preferably, it has a spring part that is held by the foot extension so as to be centered parallel between the lateral walls. Preferably, the foot extension is a flat part that is centrally positioned due to the preferably slit-like opening, so that, consequently, the spring part is imparted with its precise alignment parallel to the lateral walls. Preferably, the partition element is generally retained with some longitudinal play and/or some lateral play.

Preferably, the foot extension is in positive-locking engagement with the bottom, whereby the form-fit can be achieved by permanent deformation, for example, bending, or also by the spring action of the foot extensions or sections thereof. Considering a preferred embodiment, the ends of the foot extension are bent in transverse direction. As a result of this, the partition element can be held stationary in place or also displaying minimal play. The play may be a longitudinal play existing in the direction of movement of the slider. Additionally or alternatively, some transverse play may exist, so that the partition element is somewhat movable in lateral direction. In this manner, undesirable jamming of the slider can be reliably precluded.

Also, it is possible to bend sections of the foot extension in longitudinal direction under the bottom. In this case it is again possible to hold the partition element with some play. The play may be in longitudinal direction of the slider channel, i.e., in longitudinal direction of the slider, as well as in a direction transverse thereto.

It is also possible to support the partition element in a resilient manner, for example, with the use of detent means, on the needle body. To do so, elastic elements or resiliently supported elements may be provided on the foot extension or, alternatively, on the spring part. Such resilient sections may be, for example, spring-biased tabs that can be manufactured in a cost-effective manner by providing appropriate cutouts on the partition element.

Preferably, the needle back is provided with an indentation that may accommodate, in particular, sections of the foot extension that have been bent over. As a result of this, it is ensured that no section of the foot extension may project beyond the needle back.

In addition to the positive-locking engagement of the partition element with the needle body, the form-fitting connection may be secured by a material-locking means such as, for example, an adhesive or a locking varnish, or a welding spot.

Additional details of advantageous embodiments of the invention are the subject matter of the claims, the description and the drawings. The description is restricted to essential aspects of the invention and miscellaneous situations. The drawings disclose additional details and are to be considered supplementary.

DETAILED DESCRIPTION OF THE INVENTION

Figure 1:
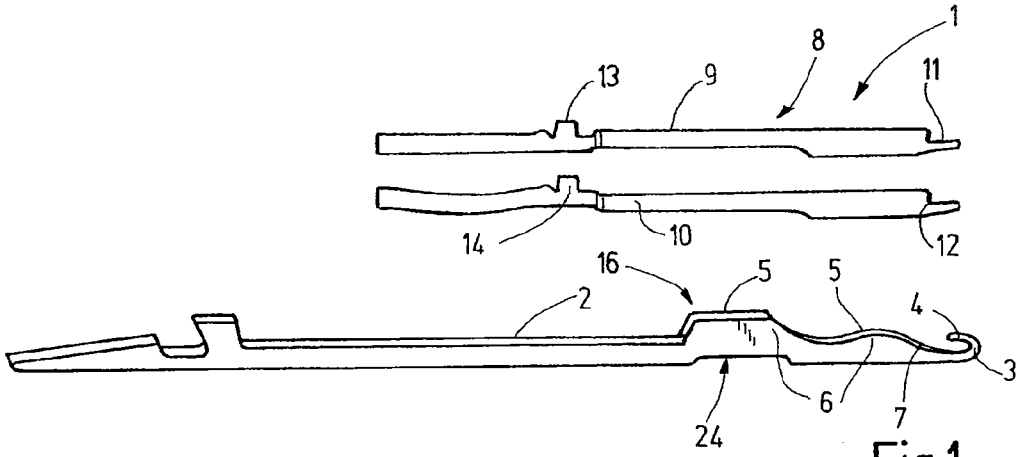
FIG. 1 is a partially exploded view of a slider needle.

FIG. 1 shows a simplified slider needle 1. This slider needle 1 comprises a needle body 2 having a hook 3 on its one end. The point 4 of the hook 3 points to a slider channel 7 defined between two lateral walls 5, 6, said slider channel being configured to accommodate a slider 8. This slider has two legs 9, 10 that preferably are configured as flexible lamella. The lugs 11, 12 extending away from the front sides of the lamella are disposed to open and close the hook 3. To do so, the slider 8 is moved back and forth in longitudinal direction in the slider channel 7. Feet 13, 14 are provided on the lamella 9 are provided to drive the slider 8. Alternatively, the lamella 9, 10 may also be held and/or driven in another manner. For example, they may be part of a one-piece slider.

Figure 2:
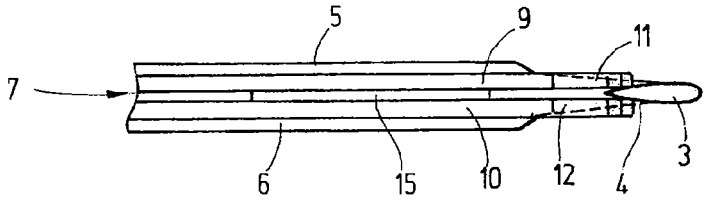
FIG. 2 is a plan view of the slider needle in accordance with FIG. 1, with the slider retracted.

As is obvious from FIG. 2, partition element 15 is arranged in the slider channel 7 between the two lateral walls 5, 6 and between the lamella 9, 10, the thickness of said partition element being selected appropriately for the intended purpose, and, for example, potentially corresponding to the thickness of the lamella 9, 10 and/or the lateral walls 5, 6. Preferably, the partition element 15 is a plane, flat sheet metal part that keeps the two lamella 9, 10 at a distance from each other. Said sheet metal part may be arranged at a suitable location of the slider channel 7, for example, in the immediate vicinity of the hook 3, as illustrated by FIGS. 2 and 3, or also, at a slightly larger distance from the hook, for example, at a location 16 as indicated in FIG. 1.

Figure 3:
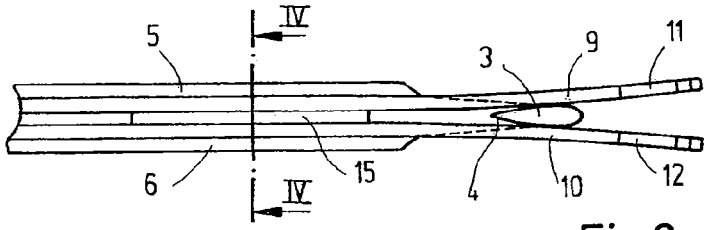
FIG. 3 shows the slider needle in accordance with FIG. 2, with the slider moved forward.
Figure 4:
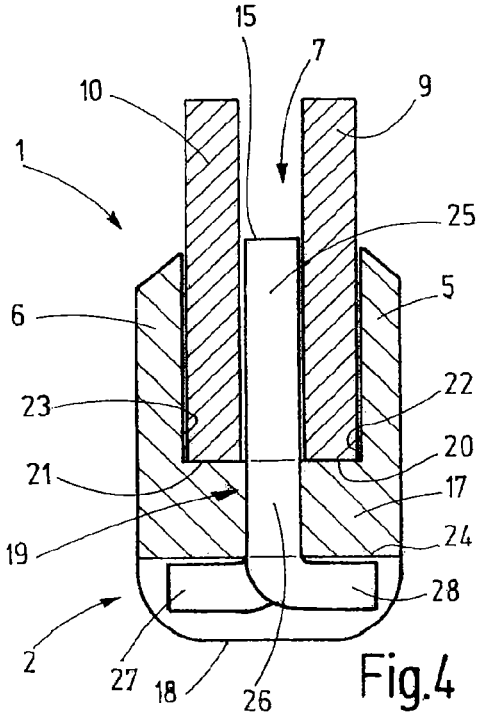
FIG. 4 is a sectional view along line IV-IV of the slider needle in accordance with FIG. 3.

FIG. 4 shows the slider channel with reference to a cross-section of a needle along line IV-IV as in FIG. 3. The slider channel 7 is delimited by the two lateral walls 5, 6 and a bottom 17, said bottom delimiting the slider channel 7 in a downward direction, i.e., toward the needle back 18. An opening 19 extends through the bottom 17, said opening leading to the needle back 18. The opening 19 may have any suitable form. For example, if it is slit-shaped, it extends as a slit, preferably in longitudinal direction of the slider channel, i.e., parallel to the lateral walls 5, 6 and to the lamella 9, 10.

Preferably, the slit-like opening 19 is arranged in the center of the slider channel 7. Preferably, said opening is narrower than said slider channel. Consequently, strip-shaped bottom sections 20, 21 are formed on both sides of the opening 19, each of said strip-shaped sections being delimited, on the outside, by the inside surfaces 22, 23 of the lateral walls 5, 6 and, on the inside, by the slit-like opening 19. Toward the needle back 18, the opening 19 preferably terminates in an indentation 24 that extends, for example, across the entire width of the needle body 2 and at least along the entire length of the opening 19 that is configured as a slit.

The partition element 15 comprises a spring part 25 that extends between the lamella 9, 10, as well as at least one foot extension 26 that projects through the slit formed by the opening 19. The foot extension 26 may extend—with minimal play—in the opening 19 of the bottom 17. As a result of this, the foot extension 26 guides the partition element 15 in lateral direction because said element may abut against the inside surfaces of the opening 19 of the bottom 17, said inside surfaces facing each other. Preferably, the partition element 15 is a sheet metal part having a uniform sheet metal thickness. As is shown by FIG. 4, sections 27, 28 of the foot extension 26 may be bent laterally away in different directions, i.e., in transverse direction of the needle, as a result of which said sections 27, 28 of the foot extension 26 extend under the bottom 17. The relationships are again shown from a different viewing perspective in FIG. 5. As is obvious, the laterally bent away sections 27, 28 of the foot extension 26 are completely accommodated by the indentation 24. Consequently, said sections do not project beyond the needle back 18.

Figure 5:
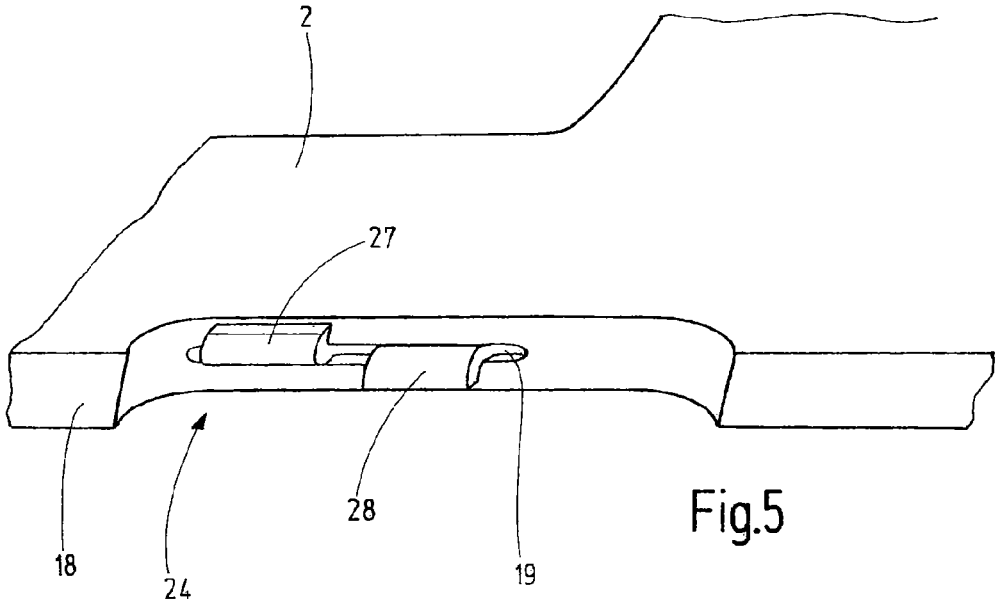
FIG. 5 is a perspective view of a detail of the slider needle in accordance with FIGS. 1 and 4, looking at the back of the needle.

The partition element 15 is held centered and positioned in a positive-locking manner by the foot extension 26. However, the partition element 15 may have some longitudinal play, as is indicated, in particular, in FIG. 5. In addition, it may have some lateral play. Although the partition element 15 thus has at least minimal play, e.g., in lateral direction or in longitudinal direction, said partition element is held on the slider needle 18 in a manner so as to be protected against loss or so that it cannot be lost, regardless of operating mode situation. A partition element 15 in accordance with FIG. 5 is position in the needle body 2 in that it is inserted from the needle back 18 into the opening 19.

Figure 6:
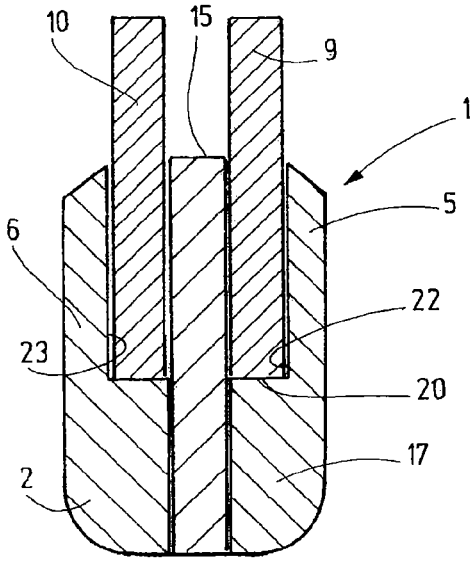
FIG. 6 is a sectional view along line VI-VI of FIG. 7 of a modified form of the slider needle.
Figure 7:
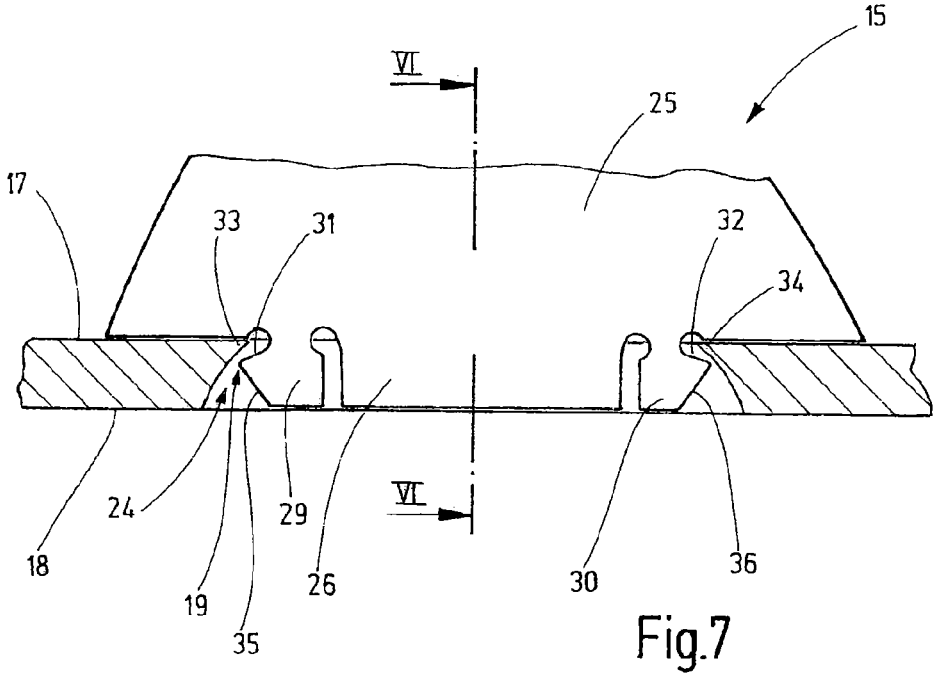
FIG. 7 is a longitudinal sectional view of a detail of the slider needle in accordance with FIG. 6.

Another option for fastening the partition element 15 to the slider needle 1 is obvious from FIG. 6 in conjunction with FIG. 7. The above description applies to this embodiment with the exception of the differences explained hereinafter while using the already introduced reference signs accordingly.

Here, the indentation 24 is configured as a slit as in FIG. 7 and FIG. 6, said slit not extending across the entire width of the needle body 2. However, the indentation 24 on the needle back 18—measured in longitudinal direction of the needle—is longer than on the bottom 17. The foot extension 26 has two sections 29, 30 that extend under the bottom 17 in longitudinal direction of the slit. The sections 29, 30, for example, are exposed by suitable cuts out of the foot extension 26. They form spring fingers with detent surfaces 31, 32. These detent surfaces 31, 32 extend under the projections 33, 34 that extend on the front-side ends of the slit-like opening 19 behind the detent surfaces 31, 32. On the sides facing away from the spring part 25, the resilient sections 29, 30 are provided with insertion inclines 35, 36. Considering this embodiment, the partition element 15 can be pushed from the needle upper side into the slit-like opening 19, whereupon it snaps in place, and the needle body 2 is held in place by detent action.

Figure 8:
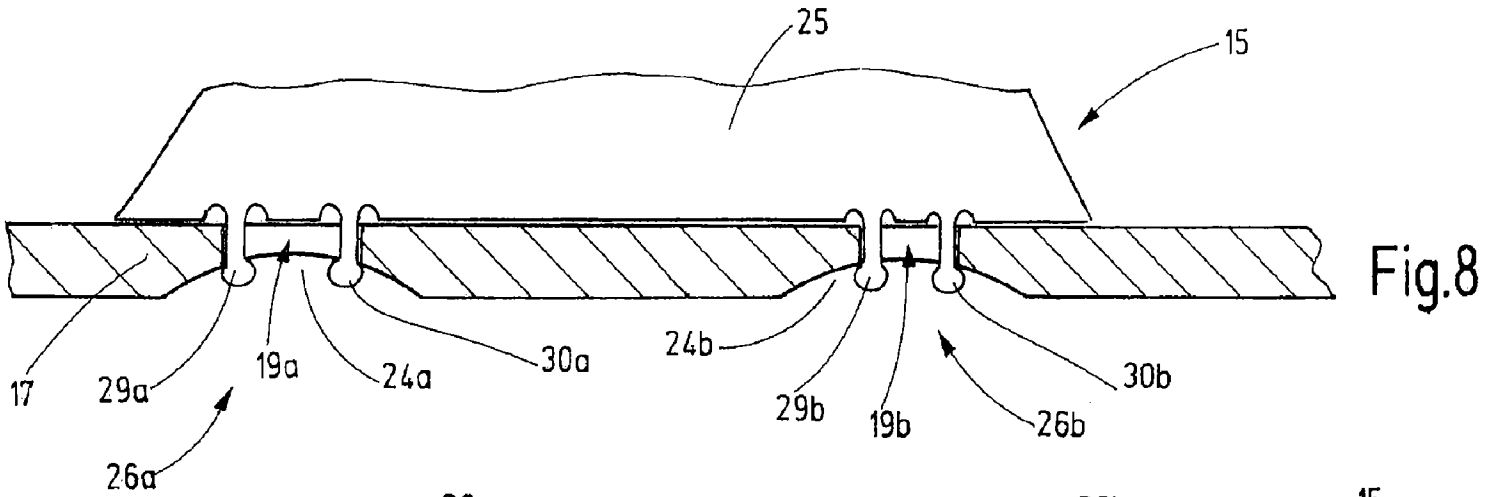
FIGS. 8 through 11 show additional embodiments of the slider needle, each representing a detail viewed in a longitudinal section.

Modified detent connections, as are shown, for example, by FIG. 8, are possible. Instead of a single opening 19, two slit-shaped openings 19*a*, 19*b* are provided, whereby said openings may terminate in corresponding indentations 24*a*, 24*b*. Again, each opening 19*a*, 19*b* may be able to hold foot extensions 26*a*, 26*b* that stabilize the partition element 15 in lateral direction. The foot extensions 26*a*, 26*b* comprise resilient sections 29*a*, 30*a*, 29*b*, 20*b* acting as detent fingers, said sections extending behind the edge of each opening 19*a*, 19*b* and thus under the bottom 17. Other than that, reference may additionally be made to the description of FIG. 7 in order to better understand FIG. 8.

Figure 9:
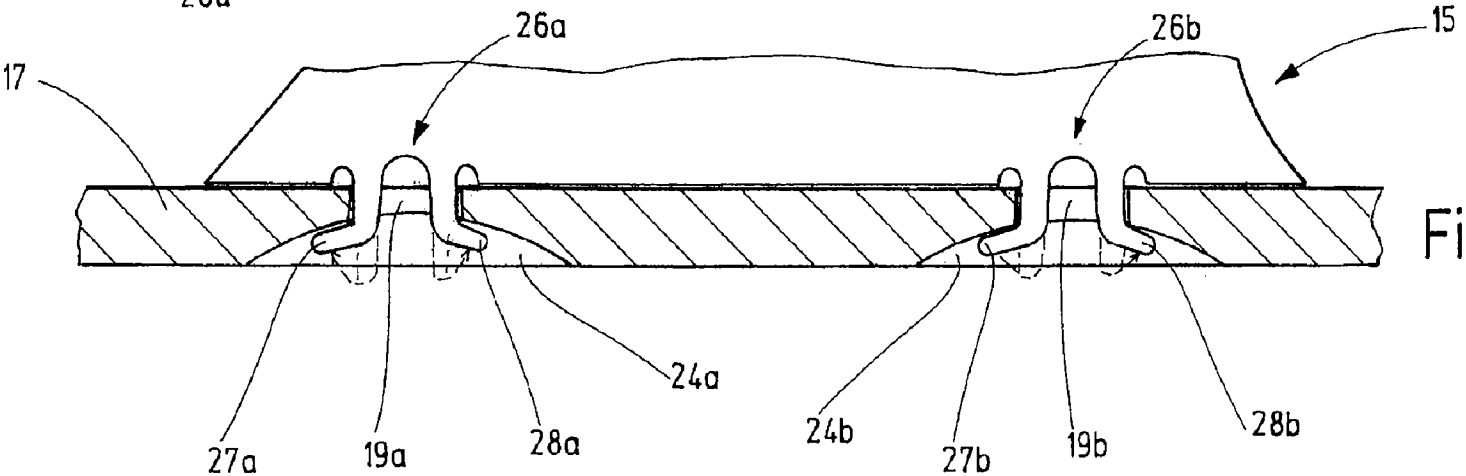

FIG. 9 again shows an embodiment of the slider needle 1, wherein the partition element 15 is secured in place due to permanent deformation. In order to secure the partition element 15, there are two foot extensions 26*a*, 26*b* (in FIG. 9 on the left and on the right), whereby, however, also only one or also three or more such foot extensions may be provided. Each foot extension 26*a*, 26*b* comprises the sections 27*a*, 28*a*, 27*b*, 28*b*. As is shown by FIG. 9, these extensions extend through respective slit-like openings 19*a*, 19*b*. There, they are bent toward the front or back in longitudinal direction of the needle in order to extend under the bottom 17. In so doing, the indentation 24*a*, 24*b* may extend across the entire needle width or may also simply be narrower. For example, the width of the slit 19*a*, 19*b* is restricted.

The partition element 15 in accordance with FIGS. 7, 8 and 9 is positioned in the needle base body 2, into which the foot extension 26 is inserted from the upper side of the needle into the opening 19 and locked therein. The partition element 15 may again be held with some play that may exist in longitudinal direction and/or in transverse direction.

Figure 10:
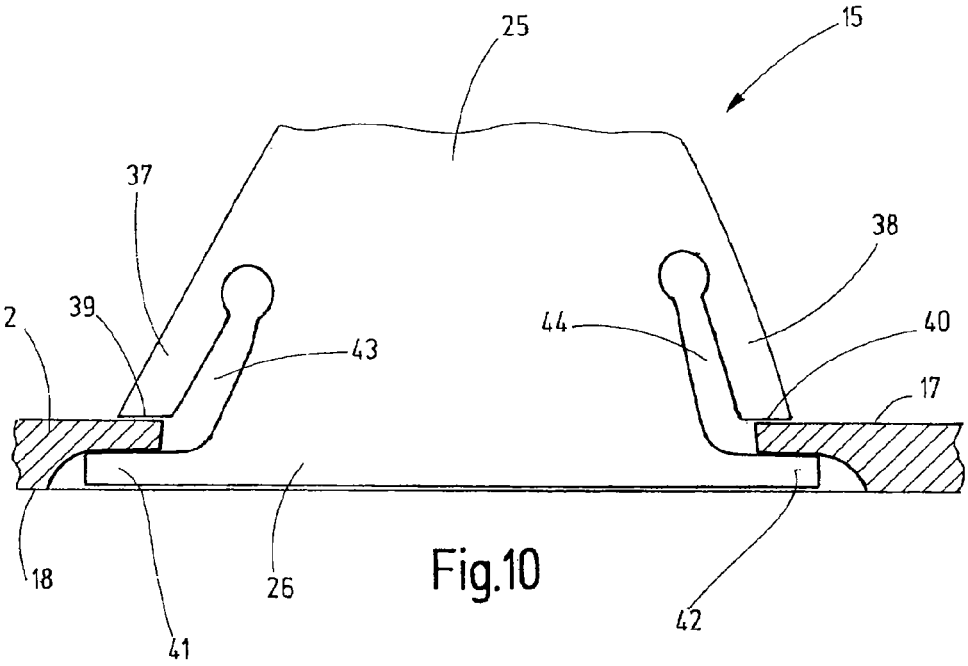

FIG. 10 shows another embodiment option. In this case, the partition element 15 is placed from the back side of the needle into the needle body 2. Here, the foot extension 26 is longer in the longitudinal direction of the needle than the spring part 25. By applying a suitable recess 43, 44 to the spring part 25, resilient fingers 37, 38 may be exposed, the front sides 39, 40 of said fingers abutting as detent surfaces against the bottom 17. In so doing, the lugs 41, 42 of the foot extension 26 extending in longitudinal direction extend under the bottom 17.

Figure 11:
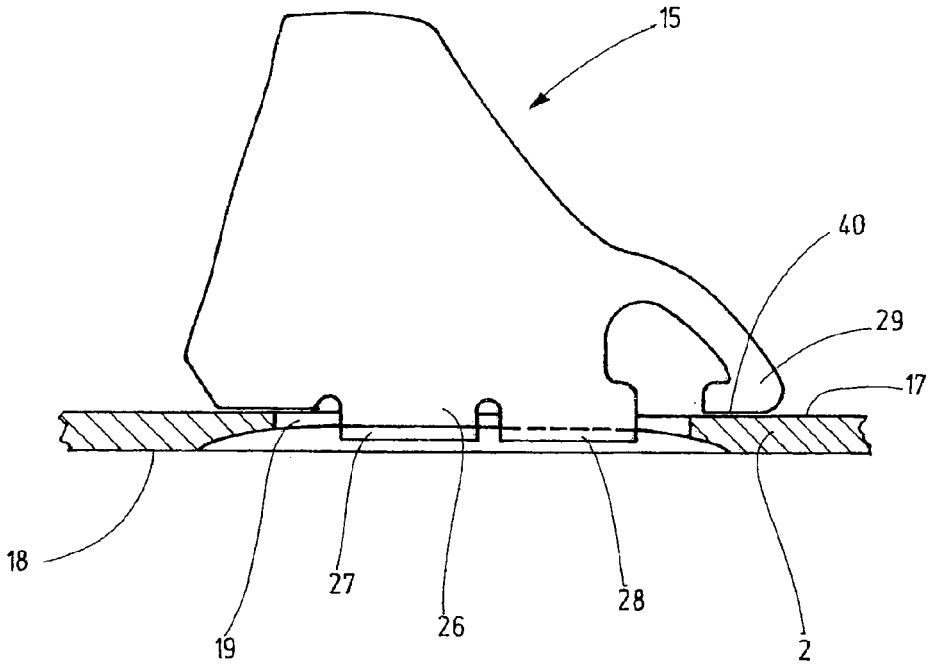

Another option for fastening the partition element 15 to the slider needle 1 is obvious from FIG. 11. The above description applies to this embodiment with the exception of the differences explained hereinafter, using as basis the already introduced reference signs. In addition to the sections 27, 28 that have been laterally bent away in a manner similar to a partition element 15 in accordance with FIG. 5, a partition element 15 in accordance with FIG. 11 may comprise at least one clip in the form of a resiliently held part 29. This resiliently supported part 29 has a front side 40 that, in assembled state, interacts with the bottom 17 of the slider channel. A partition element 15 in accordance with FIG. 11 is positioned in the needle base body 2 in that it is inserted from the needle back 18 into the opening 19 by performing a twisting motion. First, the end of the partition element 15 located opposite the clip 29 is inserted into the opening 19 and then locked in place by means of a pivoting motion. In so doing, the front side 40 of the clip 29 is positioned above the bottom 17. In so doing, the partition element 15 can be clipped into the needle base body 2.

In accordance with the invention, the slider needle 1 comprises a partition element 15 that is clipped through an opening 19 in the needle base body 2, for example, from the underside. The partition element 15 is shaped in such a manner that it can actually be easily inserted in the needle base body 2, but is still securely held, optionally with some play, as a result of positive engagement. Said partition element comprises a spring part 25 and a foot extension 26, said foot extension interacting with the bottom 17 of the slider slit. Preferably, the foot extension 26 has two sections 27, 28, 27*a*, 28*a* that are bent in opposite directions. Said sections may be bent in transverse direction or in longitudinal direction of the otherwise flat partition element 15. In the region of the opening 19 that may be configured in the form of an insertion slit, the back 18 of the needle base body 2 has an indentation 24 so that the bent over section 27, 28, 27*a*, 28*a* cannot project beyond the needle back 18. Preferably, the spring part 25 represents a one-piece component of the partition element 15. As a result of this, the loss of the spring part 15 is precluded. A cost-effective manufacture is made possible.

It will be appreciated that the above description of the present invention is susceptible to various modifications, changes and modifications, and the same are intended to be comprehended within the meaning and range of equivalents of the appended claims.

LIST OF REFERENCE NUMERALS

1 Slider needle
2 Needle body
3 Hook
4 Point (of hook)
5, 6 Lateral walls
7 Slider channel
8 Slider
9, 10 Legs, lamella
11, 12 Lugs
13, 14 Feet
15 Partition element
16 Location
17 Bottom
18 Needle back
19 Opening
20, 21 Bottom sections
22, 23 Inside surfaces
24 Indentation
25 Spring part
26 Foot extension
27, 28 Sections, bent over
29, 30 Parts, resilient
31, 32 Detent surfaces
33, 34 Projections
35, 36 Insertion incline
37, 38 Finger
39, 40 Front sides
41, 42 Lugs
43, 44 Recess

What is claimed is:

1. Slider needle (1) comprising:

a needle body (2) having a hook (3) on its one end;

a slider channel (7) provided in the needle body (2) and being delimited by a bottom (17) as well as by two lateral walls (5, 6), wherein at least one opening (19) extends through the bottom (17);

a slider (8) having at least two legs (9, 10) and being arranged in the slider channel (7) so as to be shiftable in a longitudinal direction; and, a partition element (15) located in the slider channel (7) and having at least one foot extension (26) that extends through the opening (19) and is arranged so as to extend under the bottom (17) of the slider channel (7).

2. Slider needle as in claim 1, characterized in that the lateral walls (5, 6) are arranged parallel to each other on both sides of the slider channel (7).

3. Slider needle as in claim 1, characterized in that the opening (19) is formed by at least one slit extending in a longitudinal direction of the channel.

4. Slider needle as in claim 1, characterized in that the opening (19) maintains a distance from both lateral walls (5, 6).

5. Slider needle as in claim 1, characterized in that the partition element (15) has a spring part (25) extending into the slider channel (7), said spring part being plane and arranged so as to be centered parallel between the lateral walls (5, 6).

6. Slider needle as in claim 1, characterized in that the foot extension (26) is anchored to the bottom (17) in a positive-locking manner.

7. Slider needle as in claim 1, characterized in that the partition element (15) has at least one resiliently configured section (29, 37).

8. Slider needle as in claim 7, characterized in that the resilient section (29, 37) is provided with a detent surface (31, 39).

9. Slider needle as in claim 1, characterized in that the foot extension (26) has at least one bent-over section (27, 27*a*).

10. Slider needle as in claim 9, characterized in that the bent over section (27*a*) is bent over in a longitudinal direction of the needle.

11. Slider needle as in claim 1, characterized in that the bent over section (27) is bent over in a transverse direction of the needle.

12. Slider needle as in claim 1, characterized in that the needle body (2) has, on its back side (18) facing away from the bottom (17), an indentation (24) for the accommodation of the sections (27, 27*a*) of the foot extension (26).

13. Slider needle as in claim 1, characterized in that the partition element (15) can be moved in the slider channel (7) in a longitudinal direction of the slider channel.

14. Slider needle as in claim 1, characterized in that the partition element (15) is secured by material-locking means.

15. Slider needle as in claim 4, characterized in that the partition element (15) is secured to the needle body (2) by at least one welding spot.

* * * * *